US006892969B2

(12) United States Patent
Dolan et al.

(10) Patent No.: US 6,892,969 B2
(45) Date of Patent: May 17, 2005

(54) PULP WASHING SHOWER

(75) Inventors: Patrick Lee Dolan, Washougal, WA (US); Jeffrey Allen Oram, Vancouver, WA (US)

(73) Assignee: Oramac, Inc., Vancouver, WA (US)

( * ) Notice: Subject to any disclaimer, the term of this patent is extended or adjusted under 35 U.S.C. 154(b) by 496 days.

(21) Appl. No.: 10/036,836

(22) Filed: Dec. 31, 2001

(65) Prior Publication Data

US 2002/0179745 A1 Dec. 5, 2002

Related U.S. Application Data

(60) Provisional application No. 60/295,792, filed on Jun. 5, 2001.

(51) Int. Cl.[7] ..... B05B 1/20

(52) U.S. Cl. ..... 239/566; 239/513; 239/523; 239/550

(58) Field of Search ..... 239/505, 513, 239/518, 521, 523, 524, 548, 550, 566, 511; 162/60, 275, 310

(56) References Cited

U.S. PATENT DOCUMENTS

| | | | | |
|---|---|---|---|---|
| 596,941 A | * | 1/1898 | Millspaugh | 239/511 |
| 1,163,734 A | | 12/1915 | Binns | |
| 1,396,092 A | | 11/1921 | Binns | |
| 2,767,020 A | * | 10/1956 | Knowles | 239/550 |
| 3,001,722 A | * | 9/1961 | Lawlor et al. | 239/566 |
| 3,351,291 A | * | 11/1967 | Pohle | 239/513 |
| 3,369,760 A | * | 2/1968 | Schaible | 239/513 |
| 3,859,213 A | | 1/1975 | Hunt | |
| 3,878,698 A | | 4/1975 | Friksson et al. | |
| 3,966,544 A | | 6/1976 | Johnson | |
| 4,058,262 A | | 11/1977 | Burnham | |
| 4,121,968 A | | 10/1978 | Wells | |
| 4,152,202 A | | 5/1979 | DeLigt | |
| 4,217,170 A | | 8/1980 | Luthi | |
| 4,236,999 A | | 12/1980 | Burgess et al. | |
| 4,266,413 A | | 5/1981 | Yli-Vakkuri | |
| 4,511,088 A | | 4/1985 | Wilt et al. | |
| 4,522,716 A | | 6/1985 | LaValley | |
| 4,670,099 A | | 6/1987 | LaValley | |
| 4,697,292 A | | 10/1987 | LaValley | |
| 4,795,558 A | | 1/1989 | LaValley | |
| 5,028,077 A | | 7/1991 | Hurst | |
| 5,965,017 A | | 10/1999 | Nelson et al. | |

FOREIGN PATENT DOCUMENTS

| | | |
|---|---|---|
| CH | 167073 | 4/1934 |

* cited by examiner

*Primary Examiner*—Steven J. Ganey
(74) *Attorney, Agent, or Firm*—Kolisch Hartwell, P.C.

(57) ABSTRACT

A shower pipe assembly for use in a pulp processing mill is provided to wash a pulp mat with a liquid wash. The assembly includes a pipe for conveying the liquid wash through a plurality of apertures defined through the pipe wall, the apertures spaced along a substantially straight line. The assembly also includes a plurality of substantially identical flow distributors, including a nozzle and a lip, wherein the nozzle is part of a mount that can be oriented to provide either of two configurations to the lip. The resulting structure provides the liquid wash in two angularly separated planes to the pulp mat. The mount includes a first shoulder and a second shoulder of differing thicknesses and can be selectively oriented to provide the two configurations of the lip to produce the two planes of spray.

13 Claims, 6 Drawing Sheets

PULP WASHING SHOWER

CROSS-REFERENCE TO RELATED APPLICATION(S)

This application claims priority to provisional patent application Ser. No. 60/295,792 filed Jun. 5, 2001 for "Pulp Washing Shower," which is hereby incorporated by reference.

BACKGROUND OF THE INVENTION

The present invention relates to the processing of pulp in a pulp mill, including the steps of breaking down and bleaching the pulp with chemicals, and washing the chemicals from the pulp after the breaking down and the bleaching steps. More particularly, the invention relates to a shower pipe for conveying a liquid wash to a pulp mat as a vacuum drum draws the mat out of a pulp slurry containing pulp and the breaking-down or bleaching chemicals, and an improved set of nozzles and lips coupled to the shower pipe for distributing the liquid wash to the pulp mat to wash out the chemicals.

PRIOR ART

Pulp is typically processed, i.e., broken down and bleached, in mills by soaking or mixing wood pieces in tanks with chemicals that convert the wood pieces into pulp, and then bleached pulp. The breaking down and bleaching steps each typically involve repeated steps of mixing the wood pieces or pulp in a pulp slurry in a tank, and then drawing a pulp mat out of the pulp slurry on the filter screen of a cylindrical vacuum drum. As the pulp mat is drawn from the pulp slurry, the mat is washed by spraying a liquid on it, which liquid is pulled through the pulp mat by the vacuum, thereby washing out the chemicals that had been retained in the pulp mat. Typically a series of shower pipes provide the spray of liquid wash to the pulp mat as it rotates on the vacuum drum up and out of the slurry, then to be scraped from the vacuum drum for further processing.

Shower pipes are known to be provided with rows of circular holes and flanges coupled to the holes for washing the pulp mat, but the existing pipe assemblies include certain drawbacks. For example, the shower pipe assembly shown in U.S. Pat. No. 4,795,558 includes two spaced apart rows of circular holes and a set of flanges coupled to the two rows of holes to provide two separate planes of spray. The process of lining up and forming two rows of holes, as opposed to a single row, is more difficult and costly and more prone to error in the relative placement of the holes. The shower pipe assembly of U.S. Pat. No. 4,697,292 includes an embodiment with a single row of holes, but this requires the manufacturing and installation of two different types of flanges, with each flange bent to one of two different angles, in order to provide two separate planes of spray. The manufacturing, handling, and installation cost is increased over that for a single type of flange.

SUMMARY OF THE INVENTION

The present invention provides a shower pipe with a single, substantially straight line of racetrack-shaped slots and a set of distributors, all of a single type, coupled to the slots, with a single type of mount for coupling each distributor to the pipe. The mount provides for configuring each distributor to direct a liquid wash to a pulp mat at either of two trajectories, thus providing two planes of spray of the liquid wash onto the pulp mat. The mount also provides a nozzle with a selectable orifice size, and provides a corrosion-resistant, watertight, plugging-resistant coupling between the mount and the pipe.

DETAILED DESCRIPTION OF THE PREFERRED EMBODIMENTS

Figure 1:
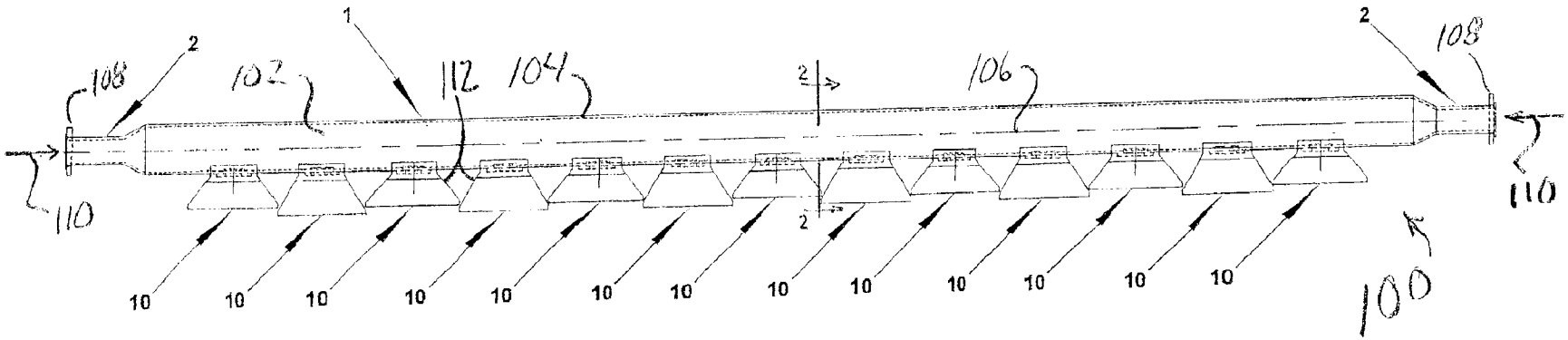
FIG. 1 is a top plan view of a shower pipe assembly according to the present invention, including the shower pipe with opposite ends providing for introduction of a liquid wash to a main body of the pipe, which defines a central longitudinal axis, and distributors coupled to the shower pipe to provide two separate planes of spray of the liquid wash.
Figure 2:
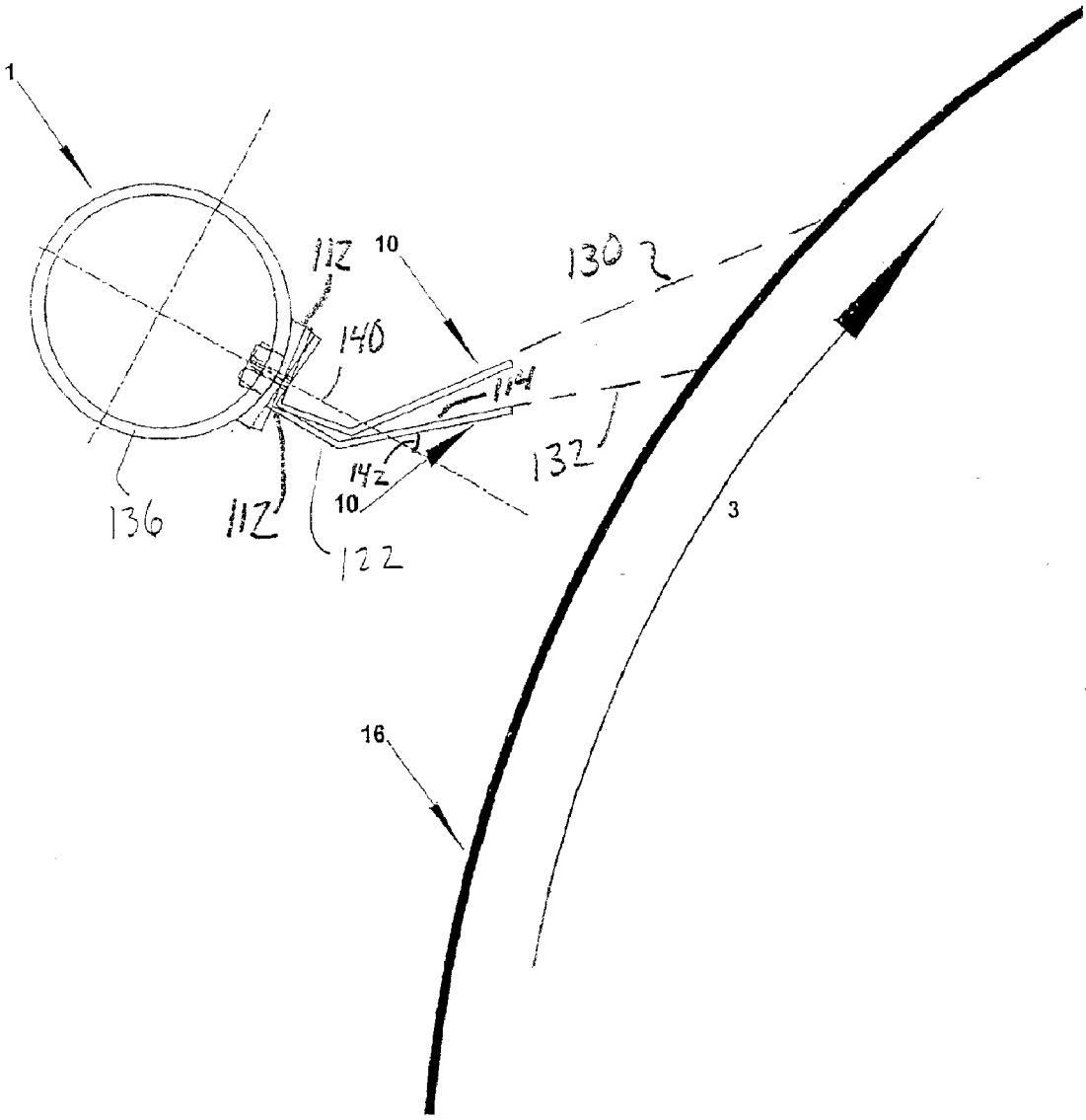
FIG. 2 is a cross-sectional view cut from the shower pipe assembly of FIG. 1, and showing the pipe body defined by a wall, a first and a second mount coupled to the wall at apertures through the wall, and a first and a second distributor, each coupled to one of the mounts to provide the two separate planes of spray of the liquid wash, and showing a pulp mat drawn up a rotating vacuum drum to which mat is applied the two planes of spray of the liquid wash.

As shown in FIG. 1, the present invention includes a shower pipe assembly, indicated generally at 100, for conveying a liquid wash 102, or filtrate, as it is commonly called, to a pulp mat 16 which rotates on the vacuum drum in the direction shown by arrows 3 in FIG. 2. Shower pipe assembly 100 includes a pipe 1, with a preferably elongate, cylindrical main body 104 defining a central longitudinal axis 106. At opposite ends, pipe 1 includes end fittings 2 for coupling to a source, by brackets or couplings 108, of the liquid wash 102. The flow of the liquid wash 102 into pipe 1 is indicated by arrows 110. Alternatively, liquid wash 102 may be conveyed into pipe 1 through only a single end fitting 2, or through another fitting suitable located anywhere on pipe 1.

Pipe 1 is preferably a cylindrical pipe, but may be formed in any suitable shape, including square or rectangular cross-section, in accordance with the invention. Pipe 1 is preferably formed of metal, typically in metallurgies ranging from mild steel to titanium or any suitable substitute, or the pipe may be formed of other materials, including plastic and other substitutes.

Figure 6:
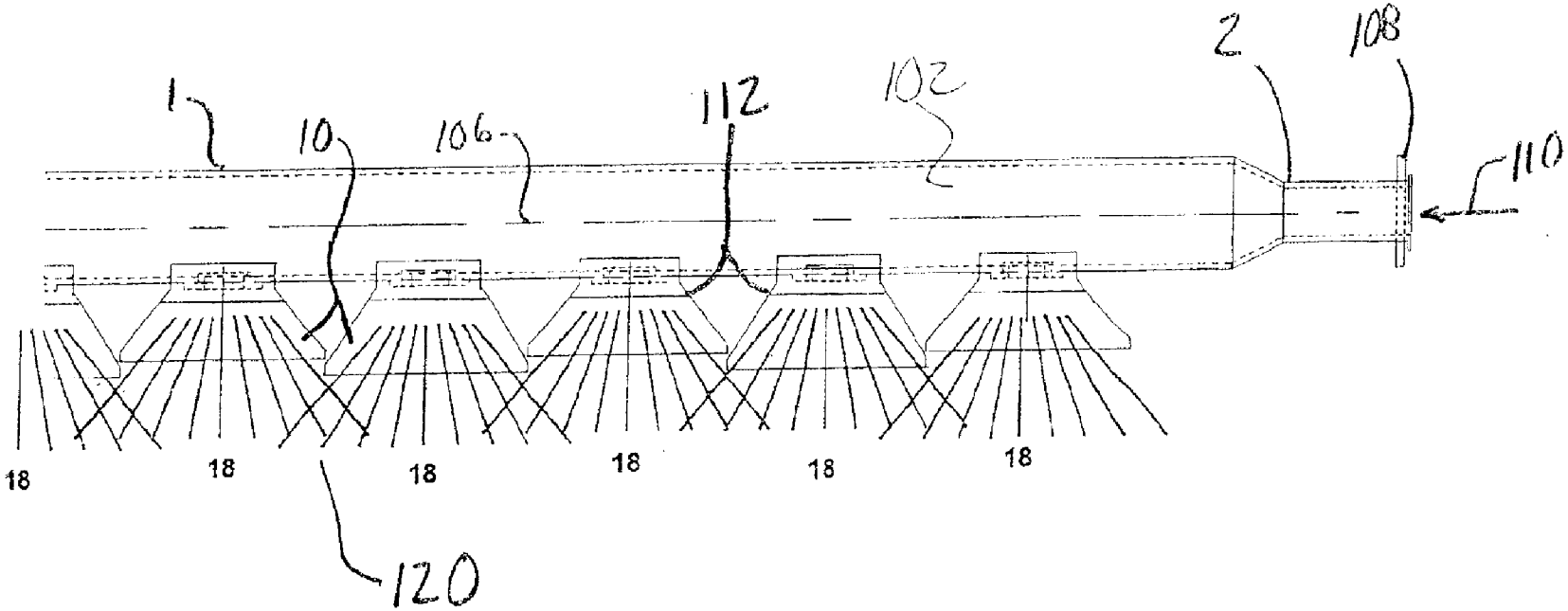
FIG. 6 is a partial top plan view of the shower pipe assembly, similar to the view of FIG. 1, showing the overlapping planes of spray.

Shower pipe assembly 100 includes a set of distribution assemblies 112 coupled to pipe 1 for providing a set of overlapping sprays 18 of liquid wash 102 to pulp mat 16 (see FIGS. 2 and 6). Each distribution assembly 112 typically includes a liquid wash distributor, such as diffusion flange 10, that spreads the liquid wash out laterally. As best seen in FIG. 6, spray 18 from each distribution assembly 112 overlaps with the spray from the next distribution assembly. However, preferably, the sprays from two distribution assemblies separated by at least one other distribution assembly do not overlap. Selection of water pressure, nozzle orifice size and shape, and spacing of the distribution assemblies all affect the degree to which the sprays overlap, and these can be selected to optimize the spray for each mill's particular application for the shower pipe assembly.

As best seen in FIGS. 2 through 5, each distribution assembly 112 includes diffusion flange 10, which typically is made of metal and preferably is made of the same grade of steel or other metal as pipe 1, or a better grade. Flange 10 in operation may be bumped or pressured by pulp mat 16, and preferably is made sufficiently strong to withstand that without breaking or bending. Flange 10 includes a preferably flat, straight outer section, such as lip 114, terminating in a flat, straight, laterally-broadened outer edge 116 over which spray 18 flows and is spread out in conjunction with sprays 18 from other flanges 10 to form an overlapping spray pattern 120 (FIG. 6). Flange 10 may be formed in alternative shapes designed to produced a desired spray pattern.

Flange 10 includes a connecting section 122 that couples lip 114 to a base 124, which is coupled preferably at a right angle to connecting section 122. Base 124 preferably provides a flat surface 126 configured to couple to a mount 6 with a complementary flat surface 128. Base 124 may alternatively be provided with any shape, preferably one complementary to that of mount 6, or to that of pipe 1 if coupled directly to the pipe. Flange 10 is preferably formed of a single unitary piece of metal, cut or stamped and then bent to the desired shape, but alternatively may be formed by connecting separate pieces, or formed of other materials in unitary or constructed forms. Flange 10 preferably includes two bolt holes 12 through base 124 for attaching with bolts 13 to pipe 1. Bolt holes 12 preferably are slot-shaped to allow position adjustment, as necessary. Base 124 of flange 10 typically includes an aperture 11 defined therethrough, preferably a racetrack-shaped slot, or other shape according with that of the pipe apertures and nozzle orifice to be discussed below. The slot shape is preferable for lateral distribution of the liquid wash 102 in spray 18.

Mount 6 is preferably a separate, polymeric nozzle and mounting system that couples flange 10 to pipe 1, although the functional structure provided by mount 6 may be incorporated into flange 10 or provided by separate mount, nozzle, and shim pieces, any or all of which may be integrated or pre-coupled with pipe 1 or with flange 10, as desired. Most preferably, mount 6 is formed of polyvinylidene fluoride or PVDF, which is typically impervious to corrosion, plugging, or abrading by the substances found in the filtrate of liquid wash 102. Mount 6 also provides a washer-like coupling between pipe 1 and flange 10, with no metal-to-metal contact therebetween, for watertight and corrosion resistant coupling.

Mount 6 is typically rectangular in plan view and partially plano-convex in cross-section, having a convex side 134 mating with the cylindrical outer dimension of pipe 1 and a planar side providing flat surface 128 mating with flat surface 126 of base 124 of flange 10. Other shapes for mating surfaces may be used, preferably complementary.

Figure 3:
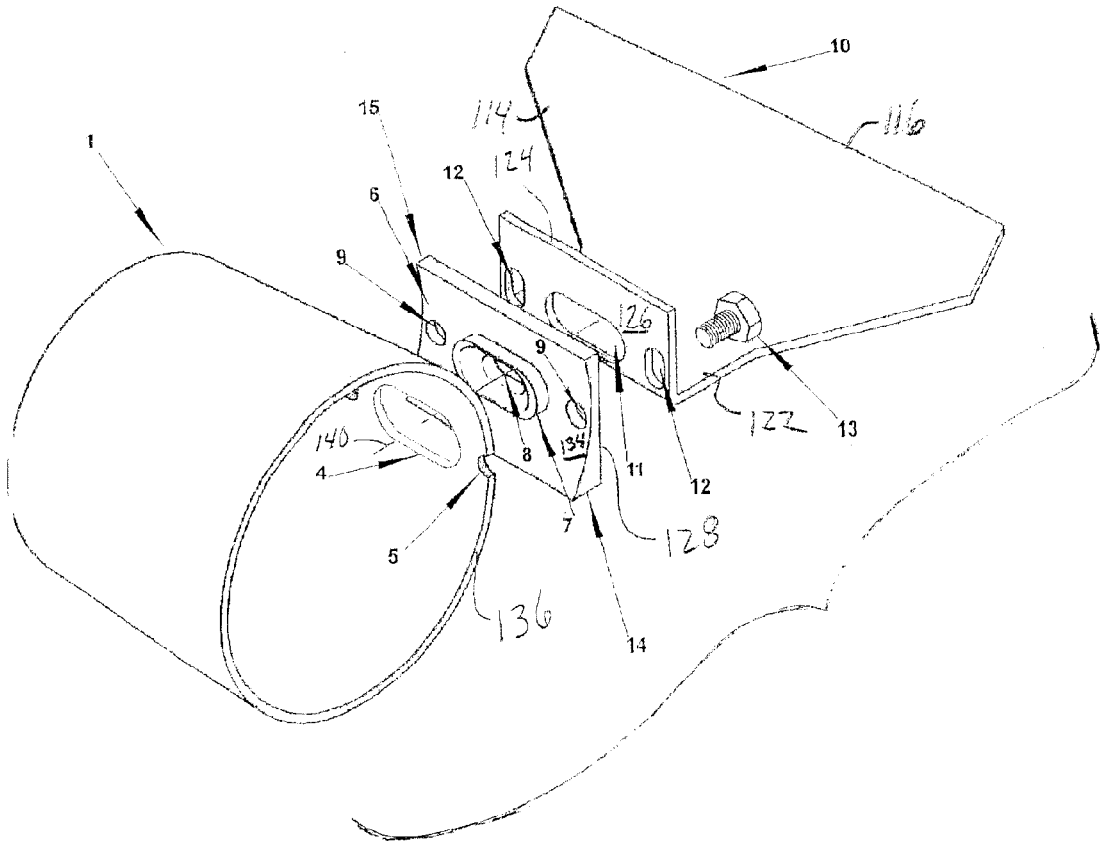
FIG. 3 is an exploded isometric view of a section of the pipe with the mount, which includes two differentially shaped shoulders, mounting holes, and an orifice of selectable size, and the distributor which includes a laterally broadening lip extending from a base that is bolted to the pipe through holes in the base, the mount and the pipe, the holes in the pipe being threaded.
Figure 4:
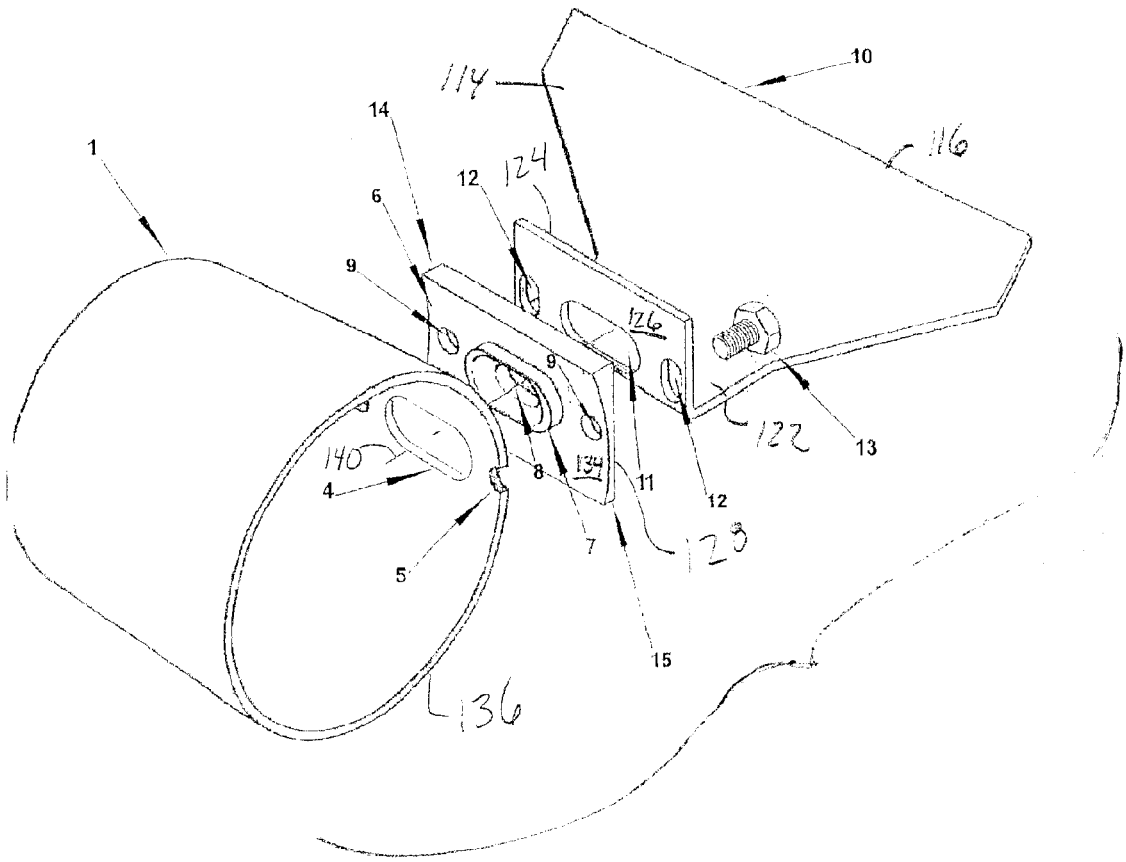
FIG. 4 is an exploded isometric view of the invention as shown in FIG. 3 with the shoulders of the mount reversed to provide the second configuration for the distributor.
Figure 5:
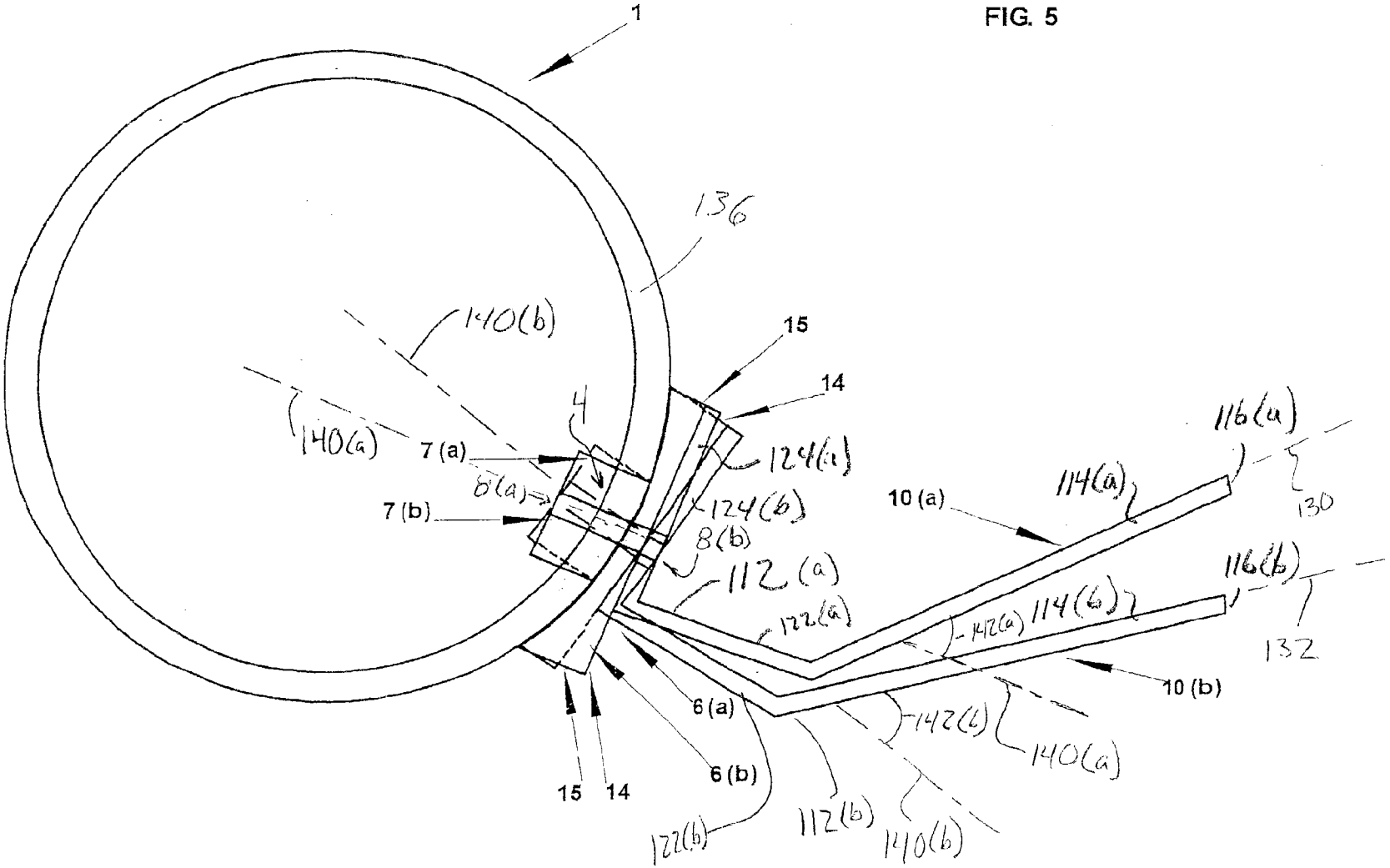
FIG. 5 is a cross-sectional view of the shower pipe assembly, expanded from the view shown in FIG. 2 to illustrate the two configurations in which the shoulders of the mount may be oriented to provide the two trajectories for the two planes of spray of the liquid wash.

Mount 6 is only partially plano-convex in cross-section in that one side or shoulder 15 of mount 6 is more narrow than opposing side or shoulder 14. These differential thicknesses of shoulders 14 and 15 provides two configurations for mounting flange 10 because the shoulders can be mounted in either of two orientations. FIG. 3 shows a first orientation with more narrow shoulder 15 mounted uppermost on pipe 1, and FIG. 4 shows a second orientation with more thick shoulder 14 mounted uppermost on pipe 1. The first orientation disposes mounting surface 128 of mount 6 at a first angle, and the second orientation disposes mounting surface 128 at a second angle, different from the first. The two orientations thus provide two configurations for mounting flange 10 to produce two different planes of spray 130, 132, as best seen in FIGS. 2 and 5, which show diffusion assemblies mounted in the two configurations, designated by use of sub-numbering (a) and (b) in FIG. 5. Other structural differences between the opposed sides of the mounts may be used to provide the two configurations, and depending on the outer shape of the pipe, more than two or infinitely variable configurations may be provided. Mounts 6 are preferably all substantially identical to one another, differing only in the orientation in which they are mounted on pipe 1.

Mount 6 includes a nozzle 7, which extends into the interior of pipe 1 through an aperture, such as racetrack-shaped slot 4 in pipe wall 136. Pipe 1 preferably includes a plurality of apertures spaced along a substantially straight line in a single row. Nozzle 7 preferably has a racetrack-shaped outer dimension with a complementary shape to mate with slot 4, although other shapes can be used, preferably complementary. The slot shape of aperture 4 and an orifice 8 in nozzle 7 promotes lateral dispersion of spray 18 as it exits pipe 1 through orifice 8 and contacts lip 114 of flange 10. Any shape or size can be selected for the nozzle orifice as determined best for the particular application of the shower pipe assembly.

Pipe 1 includes pairs of threaded holes 5 on either side of aperture 4. Bolts 13 are inserted through holes 12 in flanges 10, holes 9 in mounts 6, and into threaded pipe holes 5 for removably affixing flanges 10 and mounts 6 to pipe 1. Threaded holes 5 allow all hardware that mounts distribution assemblies 112 to remain external to pipe 1. Alternatively, captive hardware or other hardware may be used inside pipe 1. Removable attachment of distribution assemblies allows ready replacement of mount 6 and flange 10 for repair or to alter the orifice size, lip dispersal, or other characteristics of the distribution assemblies.

As best seen in FIGS. 2 through 5, aperture 4 and orifice 8 define a central axis 140 for flow of liquid wash 102 out of pipe 1 and onto lip 114 for dispersion in spray 18. Lip 114 is preferably disposed at a trajectory angle 142 relative to central axis 140, which is pointed out in FIG. 2 for one of the configurations of distributor 112. FIG. 5 also shows that for the other configuration, orifice 8 defines a slightly different central axis, and flange 114 preferably remains at the same trajectory angle 142 relative to its associated central axis regardless of the configuration. Preferably, substantially all of flanges 114 have substantially the same trajectory angle 142. Nonetheless, flanges 114 are disposed along a single row of apertures in the two configurations at two different angles to produce the two planes of spray 130, 132.

Mount 6 and flange 10 thus provide an assembly configured to be coupled to a shower pipe to direct liquid wash from the shower pipe to the pulp mat substantially in a first plane when the mount is coupled to the pipe in the first configuration, and substantially in a second plane when the mount is coupled to the pipe in the second configuration. The first plane and the second plane are angularly separated to provide substantially non-overlapping wash to the pulp mat.

While the invention has been disclosed in its preferred form, the specific embodiments thereof as disclosed and illustrated herein are not to be considered in a limiting sense as numerous variations are possible. Applicants regard the subject matter of the invention to include all novel and non-obvious combinations and subcombination of the various elements, features, functions and/or properties disclosed herein. No single feature, function, element or property of the disclosed embodiments is necessarily essential. The following claims define certain combinations and subcombinations that are regarded as novel and non-obvious. Other combinations and subcombinations of features, functions, elements and/or properties may be claimed through amendment of the present claims or presentation of new claims in this or a related application. Such claims are also regarded as included within the subject matter of applicants' invention irrespective of whether they are broader, narrower, or equal in scope to the original claims.

We claim:

1. A mount and distributor assembly for coupling to a shower pipe adjacent an aperture of the shower pipe to provide a liquid wash from the shower pipe to a pulp mat, the mount and distributor assembly comprising:

a mount configured to be coupled to the shower pipe adjacent the aperture, the mount providing a first configuration and a second configuration for coupling to the pipe, a distributor configured to be coupled to the mount, wherein the liquid wash will flow from the shower pipe to the distributor, and wherein the liquid wash will be directed to the pulp mat substantially in a first plane when the mount is coupled to the pipe in the first configuration, and the liquid wash will be directed to the pulp mat substantially in a second plane when the mount is coupled to the pipe in the second configuration, wherein the first plane and the second plane are angularly separated to provide substantially non-overlapping wash to the pulp mat, and further wherein the mount includes a first shoulder and a second shoulder, and the mount is configured for coupling to the pipe with the shoulders in a first orientation to provide the first configuration, and in a second orientation to provide the second configuration, and further wherein the first and second shoulders have substantially different thicknesses.

2. A mount and distributor assembly for coupling to a shower pipe adjacent an aperture of the shower pipe to provide a liquid wash from the shower pipe to a pulp mat, the mount and distributor assembly comprising:

a mount configured to be coupled to the shower pipe adjacent the aperture, the mount providing a first configuration and a second configuration for coupling to the pipe, a distributor configured to be coupled to the mount, wherein the liquid wash will flow from the shower pipe to the distributor, and wherein the liquid wash will be directed to the pulp mat substantially in a first plane when the mount is coupled to the pipe in the first configuration, and the liquid wash will be directed to the pulp mat substantially in a second plane when the mount is coupled to the pipe in the second configuration, wherein the first plane and the second plane are angularly separated to provide substantially non-overlapping wash to the pulp mat, and further wherein the mount includes a mounting surface, and the distributor includes a base for coupling at the mounting surface, and wherein the mounting surface is disposed at different angles in the first configuration and the second configuration.

3. A mount and distributor assembly for coupling to a shower pipe adjacent an aperture of the shower pipe to provide a liquid wash from the shower pipe to a pulp mat, the mount and distributor assembly comprising:

a mount configured to be coupled to the shower pipe adjacent the aperture, the mount providing a first configuration and a second configuration for coupling to the pipe, a distributor configured to be coupled to the mount, wherein the liquid wash will flow from the shower pipe to the distributor, and wherein the liquid wash will be directed to the pulp mat substantially in a first plane when the mount is coupled to the pipe in the first configuration, and the liquid wash will be directed to the pulp mat substantially in a second plane when the mount is coupled to the pipe in the second configuration, wherein the first plane and the second plane are anglarly separated to provide substantially non-overlapping wash to the pulp mat, and further wherein the mount includes a nozzle configured to convey the liquid wash to the distributor, and further wherein the nozzle is configured to extend through the aperture in the shower pipe.

4. The mount and distributor assembly of claim 3 wherein the nozzle includes an orifice of selectable size for controlling the flow of liquid wash to the distributor.

5. A shower pipe assembly for washing a pulp mat with a liquid wash, the assembly comprising:

a pipe for conveying the liquid wash, the pipe including a pipe wall and defining a central longitudinal axis, the pipe including a plurality of apertures defined through the pipe wall, the apertures spaced along a substantially straight line;

a plurality of substantially identical flow distributors, each distributor including a base and a lip extending from the base at a trajectory angle, wherein substantially all of the flow distributors have substantially the same trajectory angle, the flow distributors configured to be coupled to the pipe in either a first configuration or a second configuration wherein the flow distributors provide the wash in a first plane, when coupled in the first configuration, and in a second plane, angularly separated from the first plane, when coupled in the second configuration;

a plurality of mounts, each mount coupled to the pipe adjacent one of the apertures, the mounts selectably providing the first and second configurations for the distributors, wherein the mounts are substantially identical to one another, and further wherein the mounts are coupled to the shower pipe substantially at an outer surface of the pipe, and the mounts each include a nozzle extending into the associated shower pipe aperture.

6. The shower pipe assembly of claim 5 wherein the mounts include a mounting surface and the distributors include a base coupled at the mounting surface, each mount in the first configuration having its mounting surface disposed at a first angle, and each mount in the second configuration having its mounting surface disposed at a second angle.

7. The shower pipe assembly of claim 6 wherein each mount includes a first shoulder and a second shoulder opposite the first shoulder, wherein the mount is disposed with the first shoulder uppermost to provide the first configuration and with the second shoulder uppermost to provide the second configuration.

8. The shower pipe assembly of claim 5 wherein the shower pipe comprises substantially metallic material, the mount comprises substantially polymeric material, and the distributor comprises substantially metallic material.

9. The shower pipe assembly of claim 5 wherein at least some of the apertures in the shower pipe are racetrack-shaped slots.

10. A nozzle and lip assembly for coupling to a shower pipe adjacent an aperture thereof to provide a liquid wash to a pulp mat, the assembly comprising:

a nozzle configured to be coupled to the pipe, the nozzle including an orifice configured to allow the wash to pass therethrough;

a lip configured to be coupled to the pipe and to receive the wash from the orifice of the nozzle and to direct the wash to the pulp mat, the lip configured to be coupled to the pipe in either of a first configuration and a second configuration, the lip configured to direct the wash to the pulp mat substantially in a first plane when coupled to the pipe in the first configuration, the lip configured to direct the wash to the pulp mat substantially in a second plane when coupled to the pipe in the second configuration, the first and second planes being angularly separated, and further wherein the lip is coupled at an angle to a base, and the base is configured to be coupled to a mounting surface adjacent the nozzle.

11. The nozzle and lip assembly of claim 10 wherein the mounting surface extends substantially between two opposite shoulders adjacent the nozzle, and the selected orientation of the two shoulders provides the first or the second configuration for the lip.

12. The nozzle and lip assembly of claim 11 wherein the two opposite shoulders are of substantially different thicknesses.

13. The nozzle and lip assembly of claim 10 wherein the nozzle orifice includes a slot-shaped outer dimension configured to mate with a complementary shape of the aperture on the shower pipe.

* * * * *